United States Patent [19]

Bellisario

[11] 4,310,307

[45] Jan. 12, 1982

[54] DENTAL AUDIO AND GASEOUS ANALGESIA APPLICATOR

[76] Inventor: Nolan Bellisario, 1642 Rubenstein, Cardiff, Calif. 92007

[21] Appl. No.: 183,005

[22] Filed: Sep. 2, 1980

[51] Int. Cl.[3] ..... A61G 15/00

[52] U.S. Cl. ..... 433/33; 297/217; 128/203.29; 128/206.27; 179/146H

[58] Field of Search ..... 433/33, 77, 79; 297/217, 391, 403, 407, 406; 269/322; 128/203.29, 206.27, 202.18, 202.13, 206.21; 179/146 H, 156 R, 156 A

[56] References Cited

U.S. PATENT DOCUMENTS

| | | | |
|---|---|---|---|
| 414,454 | 11/1889 | Smith | 128/206.27 |
| 1,359,312 | 11/1920 | Bardwell | 128/203.29 |
| 1,649,551 | 11/1927 | Smith | 179/156 R |
| 1,698,774 | 1/1929 | Steuart | 179/156 R |
| 2,501,993 | 3/1950 | Conradt | 179/146 H |
| 2,629,023 | 2/1953 | Fitte | 297/217 |
| 2,942,072 | 6/1960 | Cunningham | 179/156 R |
| 3,069,511 | 12/1962 | Rehman | 179/156 A |
| 3,156,500 | 11/1964 | Kerr | 297/391 |
| 3,347,229 | 10/1967 | Heitman | 128/206.27 |
| 4,042,791 | 8/1977 | Wiseman | 179/146 H |

*Primary Examiner*—Robert Peshock
*Assistant Examiner*—John J. Wilson
*Attorney, Agent, or Firm*—Ralph S. Branscomb

[57] ABSTRACT

Apparatus is provided for attachment to the headrest of a dental chair which incorporates audio speakers connected to a suitable audio source and tube means conveying nitrous oxide or other analgesic gas to a nosepiece positioned on the patient whereby the patient is made comfortable with stereo music and "laughing gas" in a convenient fashion utilizing a minimum of dangling wires and tubes and cumbersome equipment.

9 Claims, 4 Drawing Figures

DENTAL AUDIO AND GASEOUS ANALGESIA APPLICATOR

BACKGROUND

Over the past three or four decades, dentistry has moved from a period of infrequent use of anesthetics into today's widespread application of all types of anesthetics and analgesics. However, for a large portion of dental patients, the fear associated with these earlier times still remains. To overcome this dental phobia, the dentist has tried many varied approaches, including music, nitrous oxide, hypnosis and accupuncture to name a few.

The apparatus referred to in this paper deals with the ultimate deliver of nitrous oxide ("laughing gas") and music to a dental patient for the purpose of creating an environment of total relaxation.

Currently available nitrous oxide delivery systems have several shortcomings; the mask is poorly designed and uncomfortable, especially for the modern practitioner sometimes working for several hours on one patient. The gas lines become heavy, dropping to the floor and being supported only by the patient's face, and tugging in the direction of the analgesia machine. These hoses are also troublesome to the office staff, having to maneuver in a very small space. Add to this a set of headphones with their accompanying wires and the problem becomes amplified once again.

The need then is for a single unit dispensing both nitrous oxide and music in a convenient, compact device permitting the dentist and staff easy access to the patient.

SUMMARY

The present invention fulfills the above-stated needs and utilizes a headpiece, shown in the disclosed embodiment as two separate side pieces, which individually house audio speakers connectable to a stereo source and means of applying nitrous oxide from a source to a nosemask on the patient.

These side pieces are preferably hinged to be moved free of the patient's head and the gas lines are provided with means of separating them from the nosepiece both to permit the hinging rearwardly of the side pieces and to permit the release of the patient's head from the headrest.

DETAILED DESCRIPTION OF THE PREFERRED EMBODIMENT

Figure 1:
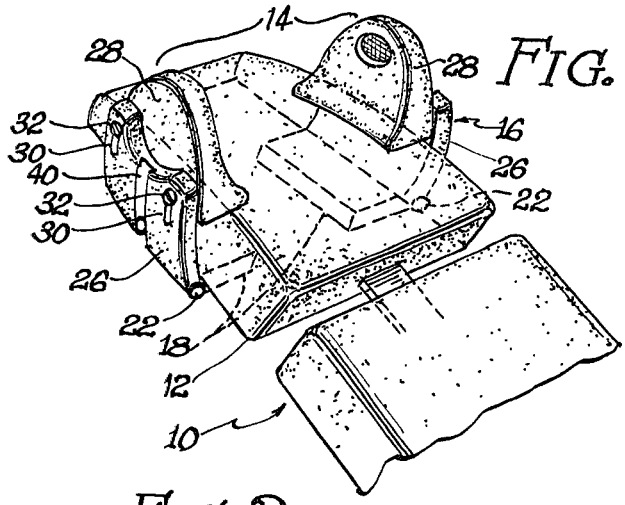
FIG. 1 is a perspective view of a dentist's chair headrest with the apparatus in place.
Figure 2:
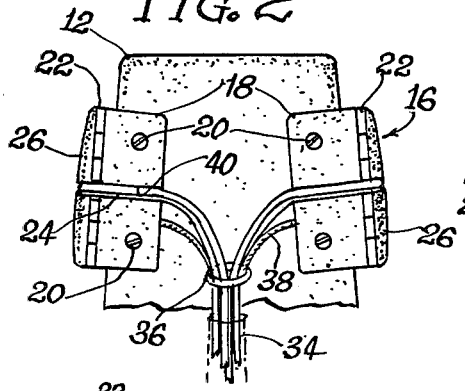
FIG. 2 is a rear elevation view of the headrest with the apparatus fastened thereon.
Figure 3:
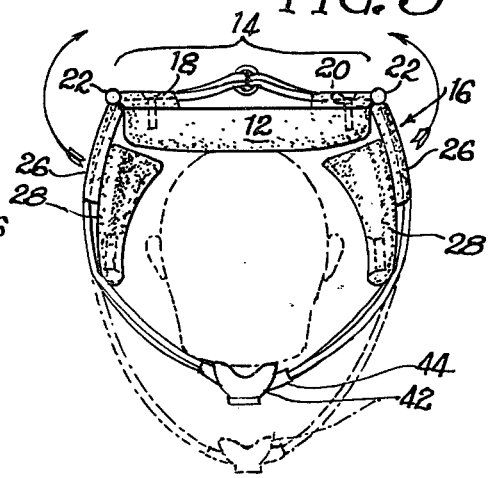
FIG. 3 is a top elevation view of the device as shown in FIG. 2.
Figure 4:
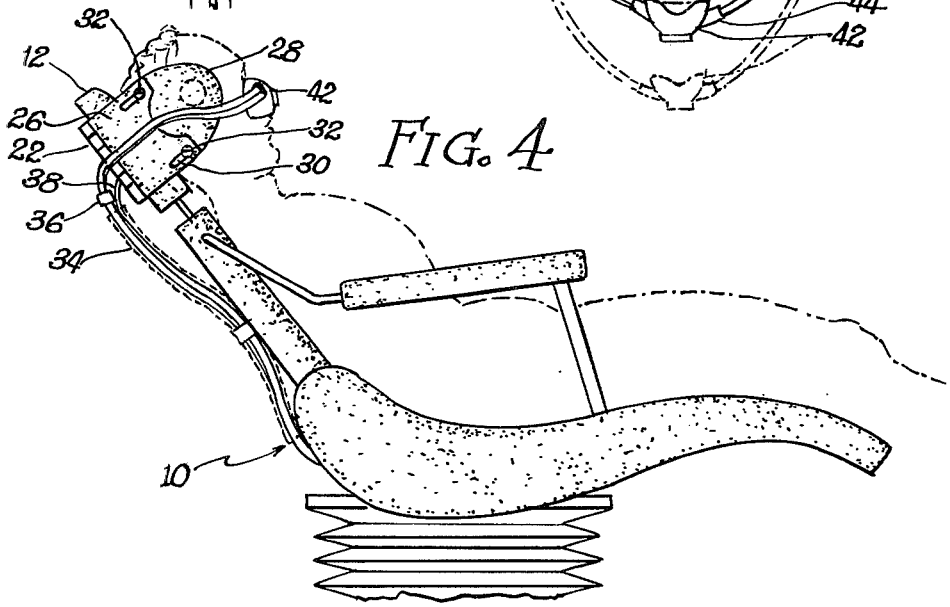
FIG. 4 is a side elevation view of a dental chair showing the patient in phantom utilizing the apparatus.

A typical modern-style dentist's chair is shown at 10 having a headrest 12. The instant invention is a headpiece 14 which could be provided as a single unit and mounted sheath-like over the headrest 12, but in the preferred embodiment disclosed herein comes as two separate side pieces 16 which separately accommodate each side of the patient's head. The utilization of two side pieces rather than a single member facilitates the accommodation of headrests of different width as clearly they can be mounted regardless of the width of the particular headrest in question.

At the rear of the side pieces are defined mounting panels 18 which in the disclosed embodiment are attached to the rear of the headrest 12 by screws 20. Clearly other means of attachment than screws could be used. At the outer edges of these mounting panels are hinges 22 which in the disclosed embodiment are centrally split to permit the passage therethrough of gas tubes 24.

Connected to the other side of the hinge of each of the side pieces is a swing-arm 26 to which in turn are mounted speaker casings 28 which are preferably adjustable forward and back by virtue of slots 30 which the screws 32 engage.

It can thus be seen that both the swing-arms 26 are adjustable rotationally and the speaker casings 28 are laterally adjustable on the swing-arms. Both of these adjustments could be frictional, i.e., sufficient friction be incorporated in the hinge and speaker casing mounts that they will remain where they are manually positioned. Clearly other means of hinging and slidably mounting these elements could be incorporated as the mechanical equivalents of those shown, and in view of the nature of the application of the apparatus naturally these functional elements would be as much as possible hidden from sight and incorporated in eye-pleasing designs.

The tubes 24 are received up from a nitrous oxide source, or lead down to a nitrous oxide vent, through a sheath 34 and an adjustable slip ring 36. Through this sheath and slip ring could also be drawn the speaker wires 38, which at their remote end connect to a patient-operated stereo tape deck or other music or sound source with volume control.

The nitrous oxide tubes 24 pass through a continuous channel 40 cut through both the back panels 18 and the swing arms 26 from whence they are entrained around the speaker casings 28 and enter into the nosemask 42 through releasible connectors 44, which could be actual hose clamps but need not be more than tubes inserted into a frictional socket. Because the tubes 24 are supported out to a location fairly near the nosemask, the nose of the patient does not bear the weight of the tubes as they do with existing gas appicators.

Because forward-to-rear adjustment of the speakers is permitted with slots 30, and mutual speaker proximity may be controlled to a large extent by means of the hinges, the instant apparatus can be adjusted for any patient. Because of the relative looseness of the gas delivery system provided by the light frictional grip of the tubes 24 in their channels 40 the gas supply system can easily be adapted to any of the adjusted settings of the speakers or side pieces. Preferably all of the apparatus is smoothly upholstered and softly contoured in conformity to the ambience of relaxation that is being promoted by the entire apparatus. The contour of the inner surface of the speaker casings also helps to direct the sound toward the ear of the patient muffling the sounds of the dental equipment.

Other modifications clearly within the spirit and scope of the disclosure and claims would include different mounting mechanisms for both the side pieces and the speaker casings, variant hinge or adjust mechanisms, and a wide variety of contours and configurations of the extending speaker casing portions of the apparatus. The essence of the invention is the simple and convenient incorporation of both sound and analgesic gas into or onto the headrest of the patient's chair adjacent the head of the patient with the benefit of full adjustability for the patient and adaptability to any existing chair.

I claim:

1. A combination audio and gaseous analgesia applicator for simultaneously supplying music from a sound source and analgesic gas from a gas source to a dental patient lying in a dental chair having a headrest, said applicator comprising:

(a) a headpiece mountable on said headrest;

(b) a pair of forwardly projecting side pieces extending from said headpiece and spaced to lie adjacent a head resting on said headrest, and including a speaker in each of said headpieces connected to said sound source;

(c) a nose piece shaped and dimensioned to substantially cover the nose only of a patient lying in said chair while exposing the mouth for access by the dentist; and (d) means mounting at least one gas tube, which tube connects said gas source and said nose piece, to at least one of said side pieces such that said tube is supported near said nose piece to carry the substantial drag of said tube which would otherwise be supported by said nose piece.

2. An applicator according to claim 1 wherein said side pieces are separate and removably mountable to said headrest.

3. Structure according to claim 2 wherein each of said side pieces is screwed to the back of a dental chair headrest whereby said headpiece will fit headrests of any width.

4. An applicator according to claim 1 wherein each of said side pieces mounts at least one tube communicating with said nose piece, one of said tubes being separable from said nose piece to expedite the disengagement of a patient from said headrest.

5. Structure according to claim 1 wherein each of said side pieces has a gas tube removeably mounted thereto and said tubes pass in front of said headpiece and both connect with said nose piece to support same from both sides.

6. Structure according to claim 5 wherein each of said side pieces defines an externally open channel dimensioned to receive and frictionally engage said tubes, and said tubes define the continuations of supply and evacuation hoses bunched behind said headrest.

7. Structure according to claim 6 wherein each of said side pieces is hinged to swing substantially clear of the head of a patient on said chair and said tubes are flexible to permit same to be snapped out of said channels and removed from the face of a patient.

8. Structure according to claim 1 wherein each of said side pieces is contoured to conform substantially to the head of a patient on said chair to eliminate sound dissipation pockets and is upholstered to absorb undesirable ambient noise in the dental office.

9. Structure according to claim 8 wherein each of said side pieces includes a speaker mounting section mounted to slots in the remaining portion of side pieces to make said speaker mounting sections slideably adjustable forwardly or rearwardly relative to said headrest to ensure coverage of the ears of a patient of any physiology.

* * * * *